US006931797B2

(12) United States Patent
Drew

(10) Patent No.: US 6,931,797 B2
(45) Date of Patent: Aug. 23, 2005

(54) ARCHED STRUCTURES AND METHOD FOR THE CONSTRUCTION OF SAME

(76) Inventor: James Joseph Drew, 1007 Skana Drive, Tsawwassen, British Columbia (CA), V4M 2L2

( * ) Notice: Subject to any disclaimer, the term of this patent is extended or adjusted under 35 U.S.C. 154(b) by 147 days.

(21) Appl. No.: 10/196,285

(22) Filed: Jul. 17, 2002

(65) Prior Publication Data

US 2003/0159370 A1 Aug. 28, 2003

(30) Foreign Application Priority Data

Feb. 25, 2002 (CA) ..... 2372943

(51) Int. Cl.[7] ..... E04B 1/32
(52) U.S. Cl. ..... 52/86; 52/89; 405/262
(58) Field of Search ..... 52/89, 86; 405/262

(56) References Cited

U.S. PATENT DOCUMENTS

| | | | | |
|---|---|---|---|---|
| 30,288 | A | 10/1860 | Vrooman | |
| 419,277 | A | 1/1890 | Murray | |
| 507,562 | A | 10/1893 | Smith | |
| 624,270 | A | 5/1899 | Vrooman | |
| 663,204 | A | 12/1900 | White | |
| 748,603 | A | 1/1904 | Henry | |
| 758,417 | A | 4/1904 | Clarke | |
| 884,498 | A | 4/1908 | King | |
| 1,064,876 | A | 6/1913 | Trujillo | |
| 3,263,378 | A | 8/1966 | Dorris | |
| 3,346,248 | A | 10/1967 | Martinet et al. | |
| 3,464,211 | A | 9/1969 | Adresen | |
| 4,325,207 | A | 4/1982 | Russell et al. | |
| 4,343,125 | A | 8/1982 | Shubow | |
| 4,458,457 | A | 7/1984 | Heierli | |
| 4,464,803 | A | 8/1984 | Bonasso | |
| 4,490,950 | A | 1/1985 | Heierli | |
| 4,589,157 | A | 5/1986 | Richard | |
| 5,069,015 | A | * 12/1991 | Steinwender | 52/575 |
| 5,269,015 | A | 12/1993 | Shires | |
| 5,351,353 | A | 10/1994 | Walters | |
| 5,456,554 | A | * 10/1995 | Barrett et al. | 405/284 |

* cited by examiner

*Primary Examiner*—Carl D. Friedman
*Assistant Examiner*—Steve Varner
(74) *Attorney, Agent, or Firm*—Norman M Cameron

(57) ABSTRACT

A first voussoir for use in an arched structure between second and third voussoirs includes a first end bearing surface with a protrusion which extends from the surface and which is mateable with a corresponding recess in an abutting end bearing surface of the second voussoir. The second end bearing surface includes a recess in the surface which is mateable with a corresponding protrusion in an abutting end bearing surface of the third voussoir. Preferably the protrusions and the recesses have both longitudinal and transverse components of structure. A connector is secured to the first voussoir for connecting one end of an associated tension member to the first voussoir while an opposed end of the tension member is connected to an associated mooring positioned at a distance away from the horizontal span of the arched structure. Arched structures comprising a plurality of such voussoirs may be constructed by successively positioning individual ones of the voussoirs in arching abutment to form a segment of the structure, then positioning a keystone. During construction, individual voussoirs may be moored to associated moorings to avoid the need for underlying shape support. After construction, they may remain moored to impart added stability to the structure.

9 Claims, 9 Drawing Sheets

ARCHED STRUCTURES AND METHOD FOR THE CONSTRUCTION OF SAME

FIELD OF THE INVENTION

The present invention relates to voussoirs and arches constructed therewith.

BACKGROUND TO THE INVENTION

The design and construction of arches is a technology that can be traced back to Roman times. Today arches are still used in a variety of structures including, culverts, bridges, tunnels and so forth.

Traditionally, arches constructed with component voussoirs are assembled by successively resting the voussoirs atop a shape support until a keystone, also known as the central voussoir, can be positioned. Once the keystone is positioned, the arch becomes self-supporting and the shape support can be removed. The shape support may be a frame, scaffolding, or simply a shaped pile of earth.

There are significant limitations to traditional methods of arch construction. The process can be complex and time consuming, requiring the pre-construction of the shape support or other means of support before the construction of the arch itself. Difficulties may be compounded if the area beneath the desired arch (for example, a roadway, a railway or a stream) is not to be obstructed during construction, or if only minimal environmental impact is acceptable.

In situations such as the construction of forestry roads for logging operations, it is desirable to be able to quickly and easily construct bridges over streams and other obstacles at remote locations with minimal damage or risk of damage to the waterways or obstacles in in question. To carry logging trucks and other heavy equipment, such bridges must be strong and reliable, Further, in many cases, such bridges must be easily removable at the end of a logging season or at the end of logging operations in a particular area. To facilitate both construction and removal, it generally can be said that such bridges should be made from components that are relatively few in number, easily transportable, and easy to assemble and disassemble using standard road building equipment such as commercially available excavators, front end loaders, light duty cranes and the like, and not equipment that needs to be custom built or specially adapted to handle the components, or to work with or around the components. Further, following assembly and disassembly at one site, the components preferably should be reusable at other sites, Voussoir design is well known and numerous adaptations have been described in the prior art. For example, U.S. Pat. No. 884,498 (King) granted on Apr. 14, 1908, describes voussoirs each having an elongated flange extending along one load bearing end and an elongated shoulder recessed along an opposed load bearing end. The flange of each voussoir is sized to seat on the shoulder of an adjacent voussoir such that the outer surface of the flange also defines part of the extrados surface of the voussoir. However, in the absence of some form of securing means, the assembled arch appears to lack desirable stability. More particularly, it appears that with a correct application of external forces the voussoirs could slip longitudinally relative to one another along their abutting surfaces.

A similar observation may be made in reference to the block construction disclosed in U.S. Pat. No. 3,346,248 (Martinet et al) granted on Oct. 10, 1967. Individual blocks mate with an elongated tongue and groove arrangement rather than a shoulder and flange arrangement as disclosed by King. They are not used as arch voussoirs (they are intended as refractory blocks in a rotary kiln), but in principle similarly configured blocks could be used as voussoirs. But, the tongue and groove arrangement then would be prone to longitudinal slippage as in the case of King.

The problem of longitudinal slippage may be partially addressed in U.S. Pat. No. 758,417 (Clarke) granted on Apr. 26, 1904. In the case of Clarke, at least some of the voussoirs have a dog-leg configuration that is fittable with corresponding dog-legs in adjacent voussoirs. Thus, an external force that might produce longitudinal slippage between the voussoirs of King or Martinet et at may be resisted by the dog-leg fitting in the case of Clarke. However, a force in the opposite direction (viz, one tending to separate the dog-leg fitting) could still produce slippage. Further, the use of dog-legged voussoirs or other irregularly shaped voussoirs having more than 6 major surfaces (viz. intrados, extrados, two opposed sides, and two opposed end bearing surfaces) may be considered undesirable for at least two reasons. Firstly, the structure of individual voussoirs is more complex and may be inherently less rugged and weaker than a simple 6-sided structure. Secondly, an excess number of specially configured additional voussoirs may be required in order to properly finish a completed arched structure. In this regard, the dog-legged structure disclosed by Clarke would require a number of L-shaped voussoirs and a number of rhomboid-shaped voussoirs in addition to the dog-legged voussoirs. Otherwise, a series of unsupported gaps would appear along opposed sides of a completed arched structure.

In each case, King, Martinet et al. and Clarke would all appear to require the use of a shape support during the construction phase of an arched structure made with their blocks or voussoirs.

U.S. Pat. No. 663,204 (White) granted on Dec. 4, 1900, describes a fireproof construct on having an arch configuration wherein pairs of arch blocks or voussoirs forming opposed sides of the arch each have a lower end adapted to rest on the foot of an I beam, and an upper end tied back to the top of the I-beam to provide a form of internal stability. However, it is not clear how the 1-beams themselves are stabilized either during construction or thereafter. Further, the blocks themselves are questionably characterized as voussoirs. Each block sweeps an angle of 90° and the overall structure does not include a central voussoir or keystone. Thus, the size of the blocks is large (each has a span that necessarily transcends one-half the horizontal span of the arch), and arch assembly and disassembly likely would require heavy duty or special purpose equipment not normally used in road construction.

It is an object of the present invention to provide a new and improved arched structure that is easy to assemble and disassemble without the need for an underlying support structure, and that may be constructed using voussoirs that are easily fabricated, rugged, and that are easily transportable in their disassembled condition.

A further object of the present invention is to provide a voussoir with features enabling an improved interlock with like voussoirs, the interlock serving not only to resist slippage between adjacent voussoirs but also to enhance the ease of assembling an arched structure.

Yet another object of the present invention is to provide a new and improved method of constructing an arched structure without the need for the use of an underlying support structure during construction.

SUMMARY OF THE INVENTION

In a broad aspect of the present invention, there is provided a first voussoir for use in an arched structure between second and third voussoirs, the first voussoir including an intrados surface and an extrados surface, each of these surfaces extending between first and second end bearing surfaces. The first end bearing surface includes a protrusion which extends from the surface, and which is mateable with a corresponding recess in an abutting end bearing surface of the second voussoir. The second end bearing surface includes a recess in the surface which is mateable with a corresponding protrusion in an abutting end bearing surface of the third voussoir. A connector is secured to the first voussoir for connecting one end of an associated tension member to the first voussoir while an opposed end of the tension member is connected to an associated mooring positioned at a distance away from the horizontal span of the arched structure.

In another aspect of the present invention, there is provided an arched structure comprising a plurality of voussoirs each including an intrados surface, an extrados surface, and end bearing surfaces as above. At least some of the voussoirs include an associated connector secured to the voussoir for connecting one end of an associated tension member to the voussoir while an opposed end of the tension member is connected to an associated mooring positioned at a distance away from the horizontal span of the arched structure. One mooring may be associated with more than one voussoir.

The ability to moor the voussoirs to a mooring distanced away from the horizontal span of the arch enables the arch to be constructed without the need for an underlying shape support. Thus, roadways, railways, streams and the like may be bridged by the arch without obstruction during construction.

Herein, when reference is made to a cable, it is to be understood that the word cable includes a wire rope, chain, rod or other flexible tension member or device, or any combination of devices that serves to perform the function of a cable.

In a further aspect of the present invention, there is provided a first voussoir for use in an arched structure between second and third voussoirs, the first voussoir including an intrados surface and an extrados surface, each of these surfaces extending between first and second end bearing surfaces. The first end bearing surface includes a protrusion which extends from the surface, and which is mateable with a corresponding recess in an abutting end bearing surface of the second voussoir. The second end bearing surface includes a recess in the surface which is mateable with a corresponding protrusion in an abutting end bearing surface of the third voussoir. A first connector is secured to the first voussoir in or at its extrados surface for connecting one end of a first lifting cable to the first voussoir. A second connector is secured to the first voussoir in or at its first end bearing surface for connecting one end of a second lifting cable to the first voussoir. As described below in more detail, the use of first and second lifting cables engaged with the first and second connectors enables the first voussoir to be more easily moved or jostled into its proper position within an arched structure. The first connector can also be used for connecting one end of an associated tension member to the first voussoir while an opposed end of the tension member is connected to an associated mooring positioned at a distance away from the horizontal span of the arched structure.

When the construction of such an arch is completed, the moorings and tension members may be removed or, alternatively, all or at least some of the moorings and tension members may be left in situ until a decision is subsequently made to disassemble the arch. Whether to leave the moorings in situ will depend upon the circumstances. It may be considered expedient to leave the moorings and tension members intact because the cost and labor of their removal is then avoided, or because they may be considered to impart desirable added stability to the finished structure. Alternately, it may be preferred to remove the moorings and tension members so that they can be used at other construction sites.

Advantageously, the protrusions and corresponding recesses noted above include both longitudinal and transverse components of structure. During construction of an arched structure, this assists to bring abutting voussoirs into full alignment with each other and to impair slippage in any direction across abutting end bearing surfaces. Further this serves to enhance the integrity of the completed structure.

As will become apparent, the provision of a lug or connector that enables a voussoir to be moored also facilitates the method of the present invention. Broadly, this method comprises the steps of successively positioning individual ones of a plurality of voussoirs in arching abutment to form a segment of an arched structure, and mooring at least some of the voussoirs each to an associated mooring positioned at a distance away from the horizontal span of the arched structure. Several voussoirs may share the same mooring. In a preferred embodiment, the voussoirs are fabricated with the associated connector included as part of the voussoir.

During assembly, and depending upon whether the voussoir includes one or two connectors as described above, each voussoir is positioned in the desired arched structure with the aid of one or two lifting tension members releasibly attached to the associated connectors or other lift point. Once positioned, the voussoir is moored to its associated mooring with a tension member connected at one end to the connector in or at the extrados surface of the voussoir and at an opposed end to the mooring.

The foregoing and other features and advantages of the present invention will now be described with reference to the drawings.

DETAILED DESCRIPTION OF PREFERRED EMBODIMENTS

Figure 1:
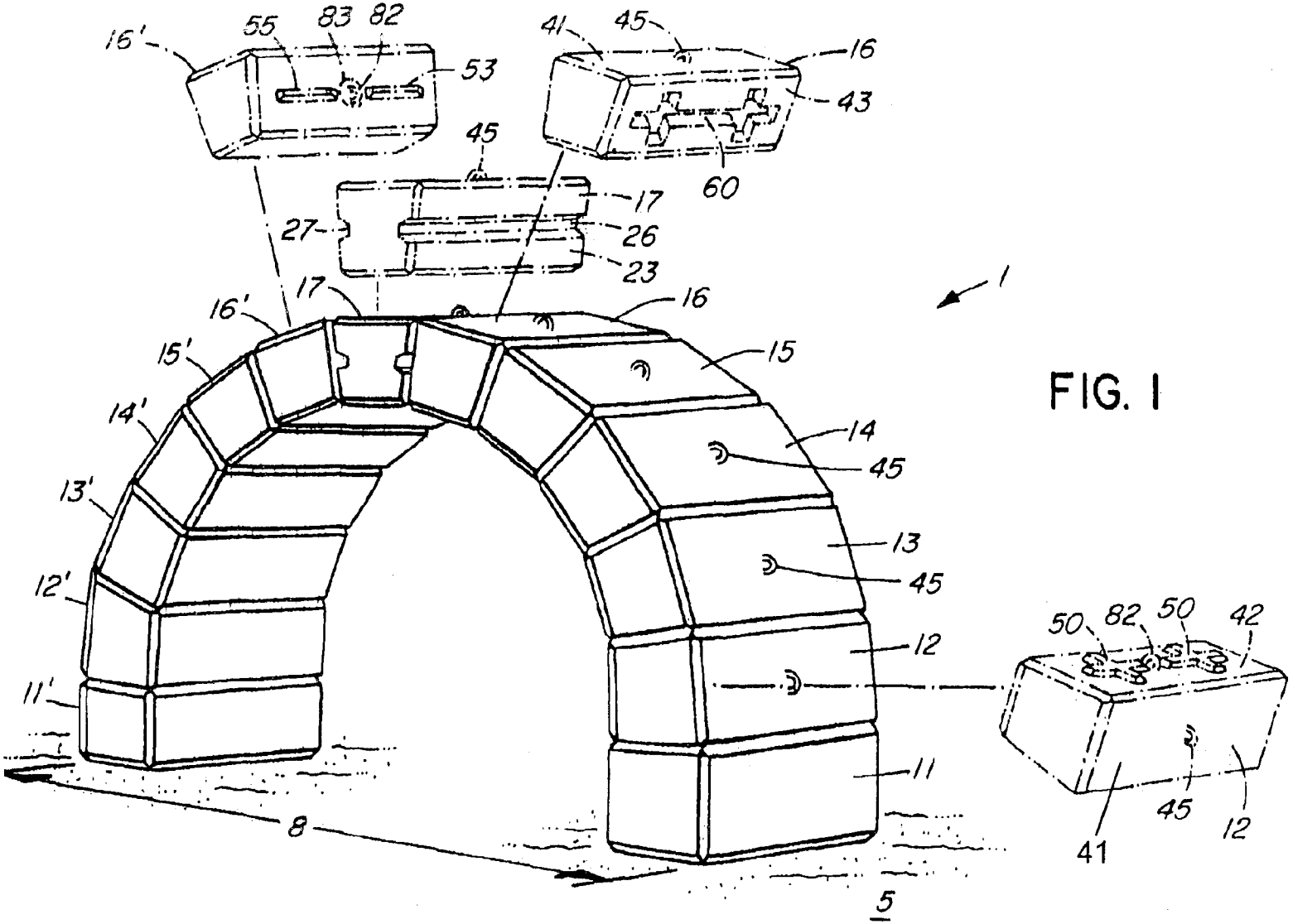
FIG. 1 is a perspective view of an arched structure in accordance with the present invention, the structure including voussoirs in accordance with the present invention, some being shown also in phantom outline.

The arched structure generally designated 1 in FIG. 1 is a simple arch comprising a central voussoir or keystone 17 and opposed pluralities of voussoirs 12–16 and 12'–16' extending in arching abutment upwardly from impost blocks 11, 11' which rest on a ground support 5 to the keystone. Arch 1 has a horizontal span 8 measured between the outer faces of impost blocks 11, 11'. For the purpose of illustration and discussion, four of the voussoirs (viz. voussoirs 12, 16, 16' and keystone 17) are shown not only in their respective positions in the structure but also in phantom outline away from the structure. In the case of voussoir 12, the phantom outline has been rotated to better reveal the upper end bearing surface of the voussoir.

In presently preferred embodiments, the voussoirs (including the keystone) are cast in molds as solid concrete blocks. The result is a rugged construction that can withstand rough handling. In a structure such as arched structure 1, they provide an economic, stable support that is able to carry relatively heavy loads. Of course, there are alternatives such as voussoirs of a non-solid construction, and the use of alternative materials such as plastics, wood and metal. Alternatives and their suitability will depend upon costs and the task at hand.

Voussoirs 12–15 and 12'–15' are substantially the same in construction. One of such voussoirs, namely voussoir 12, is shown in best detail in FIGS. 3 and 4. Voussoir 12 includes an intrados surface 40, an opposed extrados surface 41, an upper end bearing surface 42, and an opposed lower end bearing surface 43. All of these surfaces extend longitudinally between a front surface 44 and a similarly sized rear surface 46. A lug or cable connector 45 is centrally embedded in extrados surface 41 as seen in the phantom part of FIG. 1. As discussed below in relation to FIG. 6 connector (or lug) 45 facilitates both lifting and mooring of the voussoir by means of cables or chains.

Figure 3:
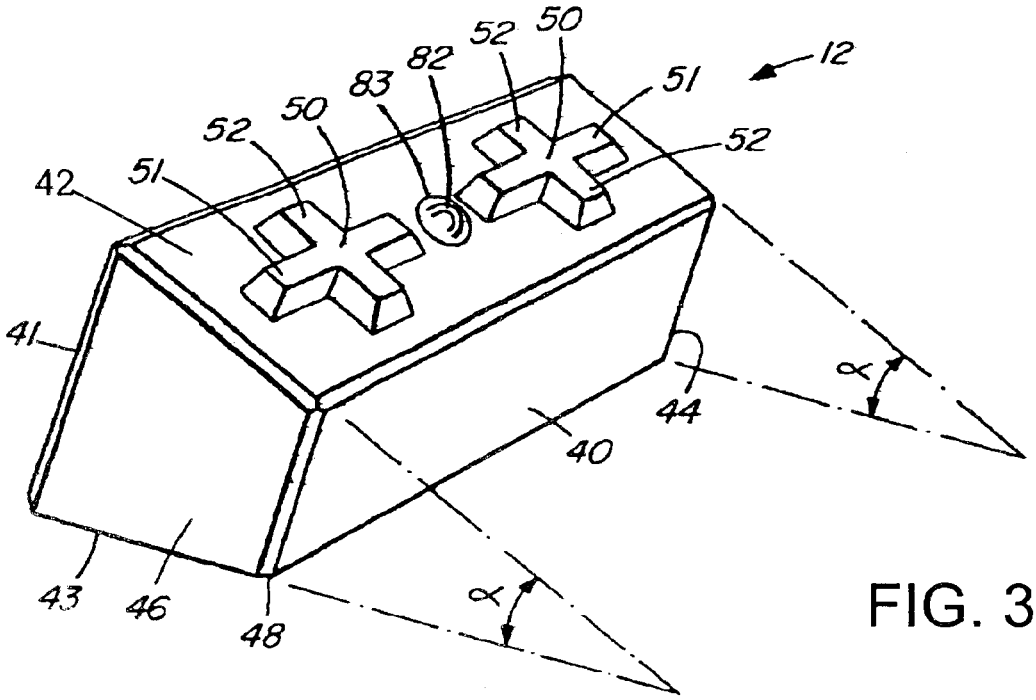
FIG. 3 is a perspective of a voussoir representative of several of the voussoirs forming part of the structure shown in FIG. 1. The voussoir is oriented to particularly show its upper end bearing surface.

The end bearing surface 42 of each voussoir is provided with an additional connector 82 which is seated in a recess 83 in the end bearing surface 42 as seen in FIG. 3. As in the case of connector 45, connector 82 facilitates lifting of the voussoir by means of a cable (see below).

Figure 4:
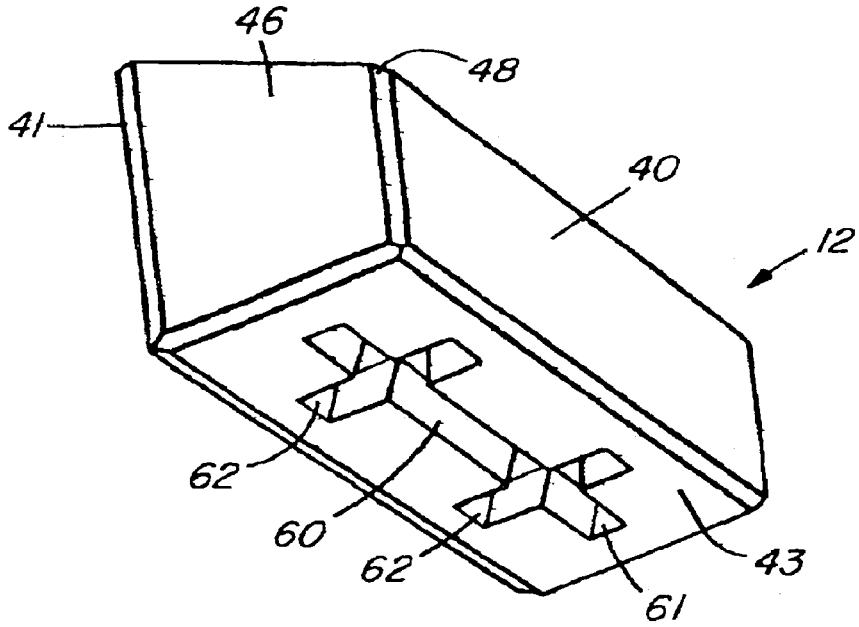
FIG. 4 is another perspective view of the voussoir shown in FIG. 3, the voussoir being oriented to show in more detail its lower end bearing surface.

It will be noted that the intersections between all of the foregoing surfaces are chamfered as, for example, chamfer 48 shown in FIGS. 3 and 4 between intrados surface 40 and front surface 44. Such chamfers serve to lessen the chance of damage to the voussoir if it is roughly handled.

End bearing surfaces 42, 43 extend in planes which, as indicated in FIG. 3, intersect at an acute angle $\propto$. The degree of acuteness necessarily determines the number of like voussoirs that will be required to sweep a given angle in the arch. However voussoirs with different degrees of acuteness may be combined in a single arch to give the arch a desired shape. It will be readily apparent to those skilled in the art that the shape and size of the resultant arch can be readily modified by changing the numbers and degree of acuteness of the voussoirs used.

As best seen in FIG. 3, a pair of cross-shaped protrusions 50 (each with a longitudinally extending component 51 and an intersecting transverse component 52) extend upwardly from upper end bearing surface 42. The side walls of these protrusions have a slight inward slope so that the protrusions 50 of voussoir 12 are easily mateable with a corresponding recess in the lower end bearing surface of abutting voussoir 13. The dimensions of the recesses are slightly larger than the dimensions of the cross-shaped protrusions to facilitate ease of assembly and to allow abutting blocks to be easily jostled to an interlocking position. Although not shown in the drawings, it will be understood that the recess in voussoir 13 is substantially the same as recess 60 shown in FIG. 4 in lower end bearing surface 43 of voussoir 12. Recess 60 includes a longitudinally extending component 61 and a pair of transversely extending components 62. In arched structure 1, recess 60 in voussoir 12 mates with corresponding protrusions extending from the upper end bearing surface of impost block 11. It will be apparent that even if connector 82 protrudes beyond end hearing surface 42, it will be accommodated by longitudinally extending component 61 of recess 60. The protrusions of impost block 11 are not shown, but it will be understood that the engagement between impost block 11 and voussoir 12 is in all material respects the same as that between voussoir 12 and 13. The same is true between all abutting pairs of voussoirs in the series from voussoir 12 to voussoir 16 and in the series from voussoir 12' to voussoir 16'.

Figure 5:
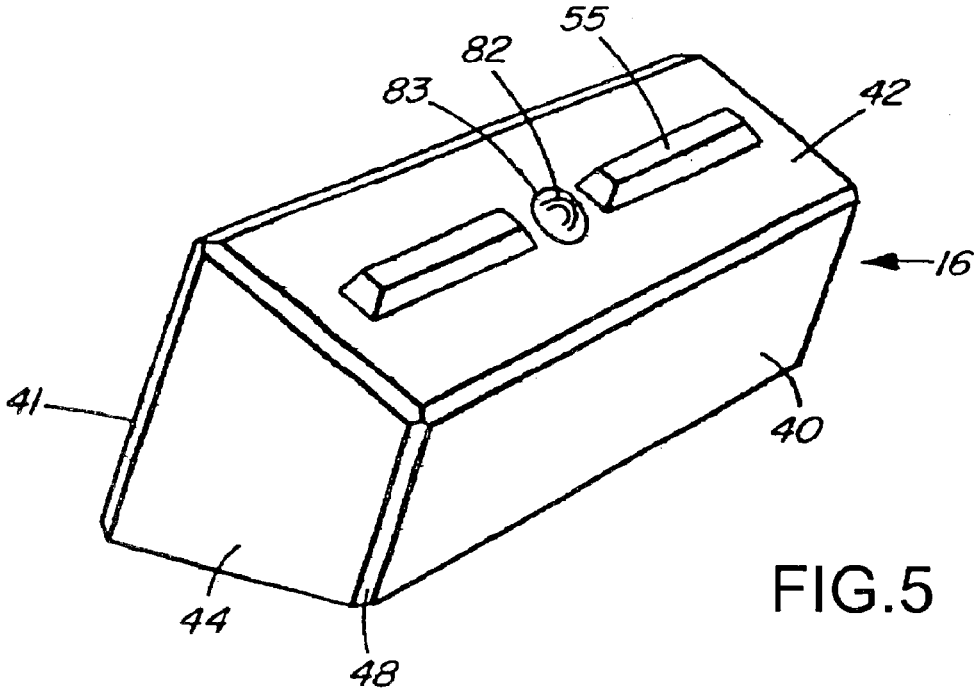
FIG. 5 is a perspective view of a voussoir representative of the voussoirs abutting the keystone in FIG. 1. The voussoir is oriented to particularly show its upper end bearing surface.

Voussoir 16 is shown in best detail in FIG. 5 which is equally representative of voussoir 16'. Instead of a pair of cross-shaped protrusions 50 as in the case of voussoirs 11–15, 11'–15', voussoirs 16, 16' include a pair of longitudinally extending linear protrusions 55 extending upwardly from upper end bearing surfaces 42. This is the only substantive difference between the construction of voussoirs 16, 16' and voussoirs 12–15, 12'–15' and facilitates sliding keystone 17 horizontally into place without the need to substantially displace the sides of the arch, For example, and as indicated in FIG. 1, lower end bearing surface 43 of voussoir 16 includes a recess 60 as in the case of voussoir 12. Although not visible, the same is true of voussoir 16'. As well, connectors 45 and 82 are embedded in the surfaces of voussoirs 16, 16' as in the case of voussoir 12.

Preferably, protrusions 55 are sized and positioned the same as longitudinally extending components 51 of cross-shaped protrusions 50. Then, the same design of mold can be used to cast all of voussoirs 12–16 and 12'–16'. In this regard, it will be understood that after a voussoir such as voussoir 12 has been cast in concrete, it can be transformed into a voussoir 16 or 16' merely by chipping or cutting away the transverse components 52 of cross-shaped protrusions 50.

Figure 2:
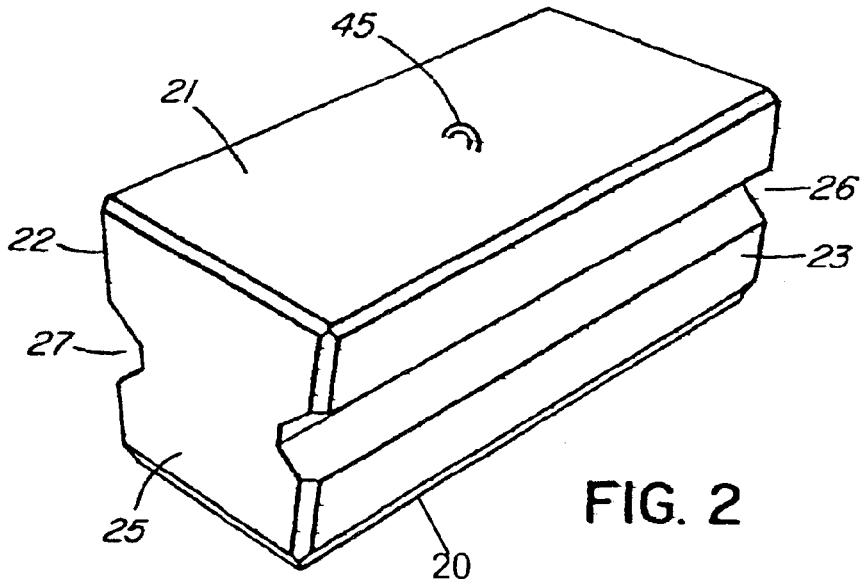
FIG. 2 is a perspective view of the central voussoir or keystone forming part of the structure shown in FIG. 1.

Keystone 17 fits between uppermost voussoirs 16 and 16', as seen in FIG. 1 and is shown in best detail in FIG. 2. It includes an intrados surface 20, an opposed extrados surface 21, and a pair of end bearing surfaces 22, 23 tapered downwardly and inwardly in the classic manner of a keystone. All of these surfaces extend longitudinally between a front surface 25 and a similarly sized rear surface. A connector 45 is embedded in extrados surface 21. End bearing surfaces 22,23 each include a longitudinally extending groove 26, 27 sized for horizontal sliding engagement with linear protrusions 55 of adjacent voussoirs 16, 16'.

Impost blocks 11, 11' are similar in construction to voussoir 12, including protrusions 50 as shown in FIG. 3 and a recess 60 as shown in FIG. 4. However, they do not include a connector 45. Further, the upper and lower end bearing surfaces of blocks 11, 11' extend substantially in parallel rather than planes intersecting at angle $\propto$. So configured, it will be understood that one or more additional impost blocks may be added below block 11 and/or 11', the result being to increase the overall height of arched structure 1, or to allow one side of the arch to extend upwardly from a ground level different from the other side of the arch.

Connectors 45 and 82 are metal connectors embedded in the concrete at the time the voussoir or block is cast. They are strong enough to carry the weight of the voussoir or block of which they form part and, as discussed below, are suitable for the attachment of a lifting cable and/or a chain, as the case may require. It will be apparent to those skilled in the art that there is a wide range of means other than connectors that may be used to serve the purpose. They may be replaced by any fixture suitable for a lifting attachment or for securing a tension member. Possibilities include countersunk tie bars, clips, open ended hooks and others.

The assembly of arched structure 1 will now be described with reference to FIGS. 6, and 9–11.

Figure 6:
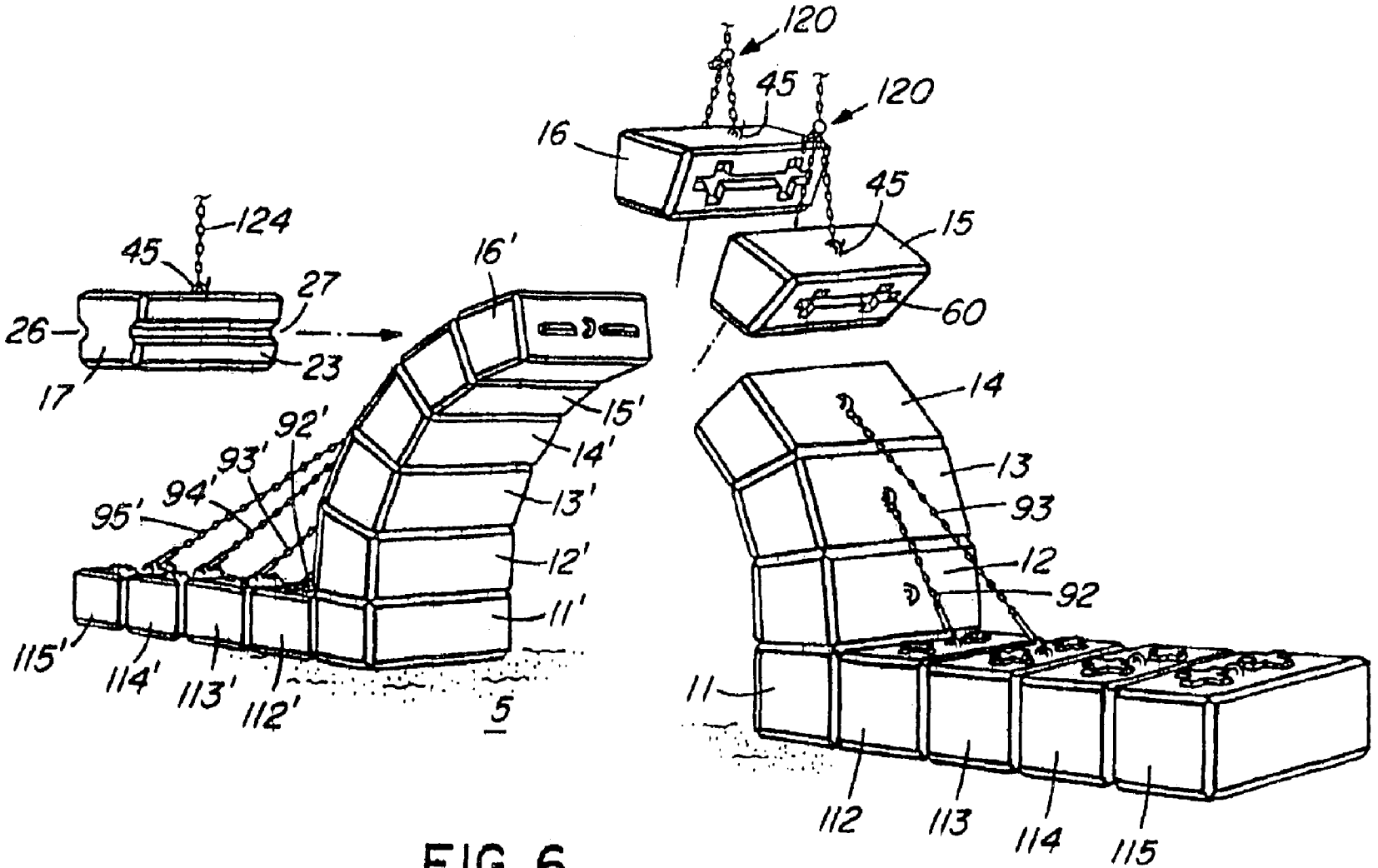
FIG. 6 is a perspective view illustrating the arched structure shown in FIG. 1 in a partially assembled condition. This view also shows the mooring of voussoirs to anchor blocks.

In FIG. 6, the left side of the structure comprising impost block 11' and voussoirs 12'–16' has been assembled by successively positioning voussoirs 12'–16' in arching abutment with each other, one above the other, voussoir 12' having first been positioned atop impost block 11'. The right side of the structure comprising impost block 11 and voussoirs 12–16 is under construction. Impost block 11 and voussoirs 12–14 have been positioned, but voussoirs 15–16 are not yet in position. Likewise keystone 17 is not yet in position.

FIG. 6 also shows the mooring of certain ones of the voussoirs (viz. voussoirs 13–14 and 13–16') to associated mooring or anchor blocks (viz. 112–115 and 112'–115') by means of associated tension members, preferably flexible, in this example tension members or chains (viz. 92–93 and 92'–95'). All moorings are positioned at a distance away from the horizontal span 8 of the arch.

Figure 9:
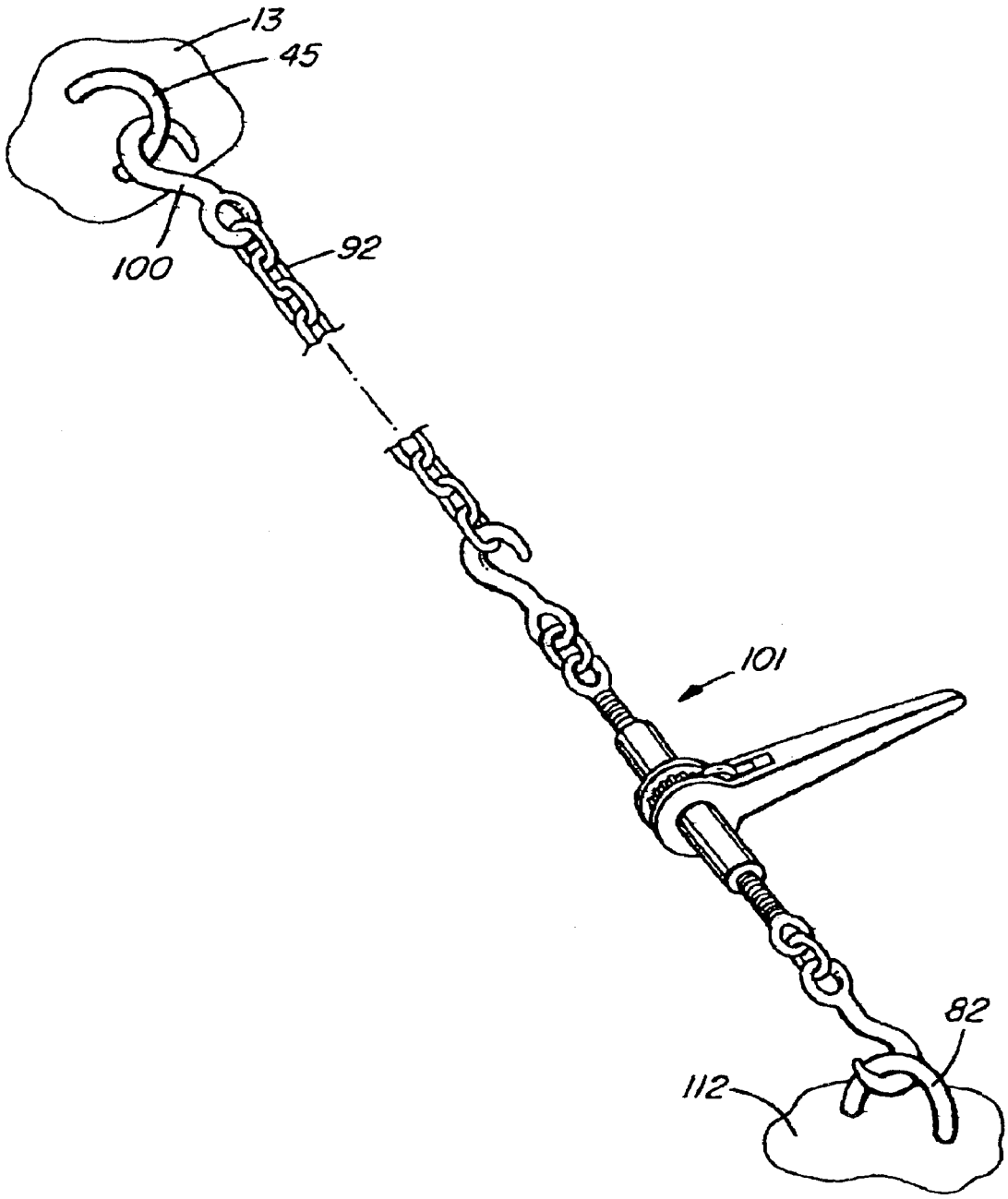
FIG. 9 is a perspective view showing the incorporation of a turnbuckle and double ended cable hook in a tension member.

As shown in best detail in FIG. 9 for the example of flexible tension member, or chain 92, each tension member includes a suitable length of chain hooked at one end to connector 45 of the associated voussoir (e.g. voussoir 13) by a hook 100 and at the other end to connector 82 of the associated arch or block (e.g. anchor block 112) by a standard chain turnbuckle generally designated 101.

At the stage of assembly shown in FIG. 6, anchor blocks 114–115 have not yet been used for mooring purposes, but ultimately would be so used to moor voussoirs 15–16.

Conveniently, anchor blocks 112–115 and 112'–115' are identical in construction to impost blocks 11, 11'. But, it will be noted that they not only provide mooring or anchor points but also serve to brace the impost blocks from sliding outwardly. Depending on ground conditions, the bracing characteristic may not be needed, but it will be useful in some circumstances where a possibly undesirable alternative would be to replace impost blocks 11, 11' with more secure footings set in the ground. In this example the anchor blocks are aligned in a linear manner with the arch structure as seen in FIG. 6.

Figure 10:
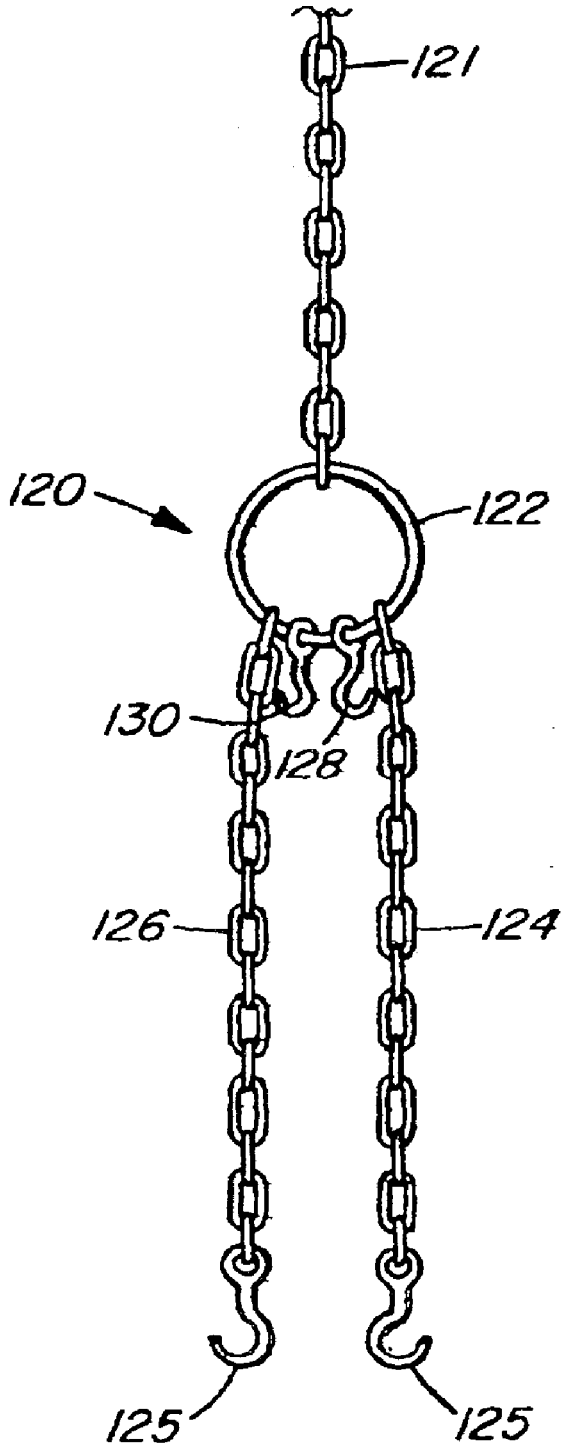
FIG. 10 illustrates an adjustable sling that may be used to carry voussoirs and other building elements during assembly or disassembly of an arched structure in accordance with the present invention.
Figure 11:
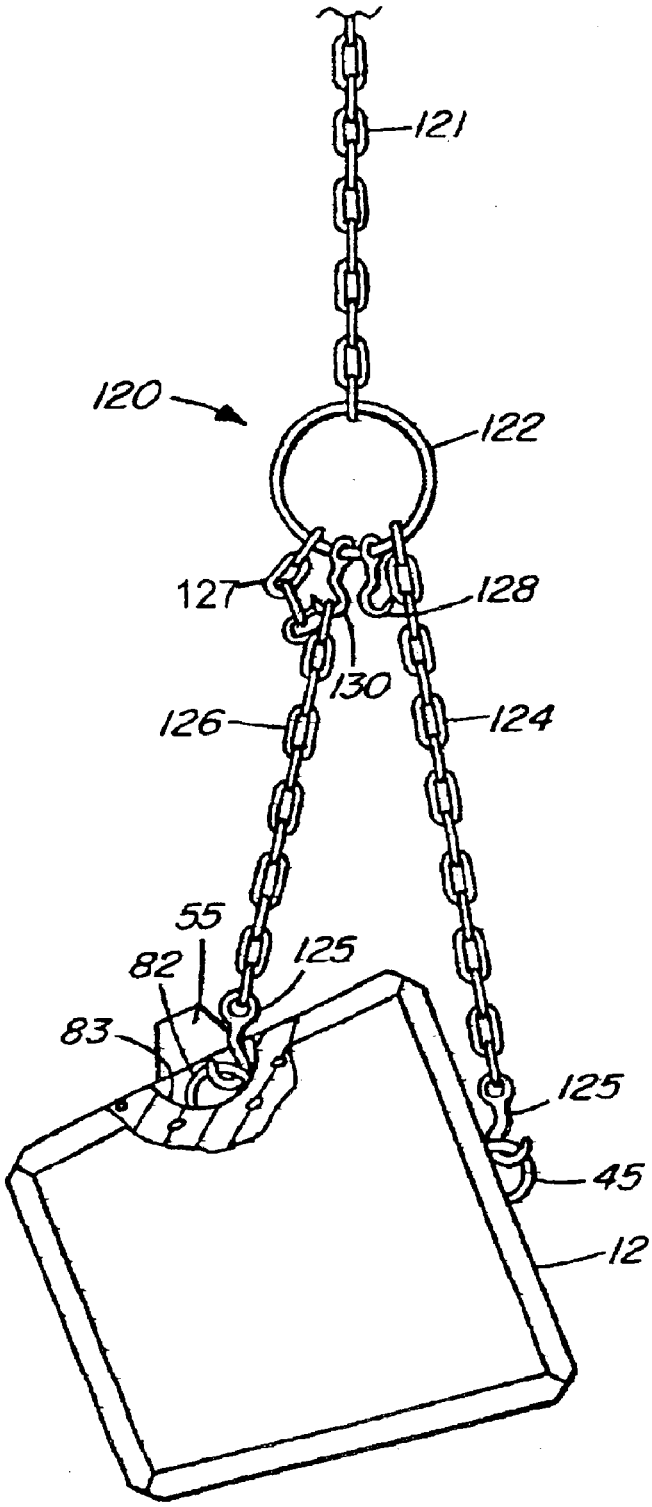
FIG. 11 illustrates a voussoir being carried by the sling shown in FIG. 10.

All voussoirs 12–16 and 12–16', keystone 17, impost blocks 11, 11' and anchor blocks 112–115 and 112'–115' are positioned with the aid of an adjustable sling generally designated 120. As best seen in FIGS. 10–11, sling 120 comprises a primary lifting cable or chain 121 (also called a flexible tension member herein) linked at its lower end to a holding ring 122, and a pair of sling chains 124, 126 linked at their upper ends to ring 122. Each sling chain 124, 126 includes a hook 125 at its lower end that may be releasably hooked to either connector 45 or 82 of any one of the voussoirs or blocks. A pair of grab hooks 128, 130 is carried by ring 122 between chains 124, 126. Each grab hook may be releasably hooked with any selected link of chain 124 or 126 to shorten the effective length of the chain. For example, in FIG. 11 the effective length of chain 126 has been shortened or taken up through engagement by grab hook 130. As a result a portion 127 of chain 126 is slack and unused. As a further result, the voussoir shown in FIG. 11 is carried at a significant angle of tilt.

Chain 121 extends upwardly from ring 122 to a crane or other suitable lifting device (not shown) which is used to hoist and carry each voussoir away from a transport (e.g. a flatbed truck) to a desired position in the arched structure. During movement of at least some of the voussoirs into their final positions, it will be desirable for the angle of tilt of the lower end bearing surface 43 of the voussoir to at least approximate that of the upper end bearing surface 42 of the voussoir which it is about to abut. As indicated by FIGS. 10–11, differing tilts are realized with appropriate use of chains 124, 126 and grab hooks 128,130.

By way of example, FIG. 6 shows voussoir 15 being lowered towards voussoir 14 with an angle of tilt compatible with the angle of the upper bearing surface of voussoir 14. It also shows (notionally at a later point in time), voussoir 16 being lowered towards voussoir 15 with a lesser angle of tilt (viz, with an angle of tilt compatible with the angle of the upper bearing surface of voussoir 15). Further, FIG. 6 shows the horizontal movement of keystone 17 for final positioning between voussoirs 16 and 16'. In this case, no angle of tilt is desired. Hence, only one of the sling chains is used (viz, arbitrarily chain 124); for the purpose of clearer illustration, chain 126 is not shown.

In more detail, and again by way of example with reference to voussoir 15 in FIG. 6, it should be noted that if the tilt of voussoir 15 and the alignment between voussoirs 14 and 15 is ideal as voussoir 15 is lowered into position, then recess 60 of voussoir 15 will seamlessly mate with cross-shaped protrusions 50 of voussoir 14. If the tilt is not ideal or if there is a minor amount of misalignment, then protrusions 50 should contact the walls of recess 60 in a manner that serves to guide voussoir 15 into proper alignment with voussoir 14. Clearance space in recess 60 provides leeway to compensate for the difficulties of making a perfect initial alignment between the voussoirs. The voussoirs may be jostled into better alignment after the voussoirs are positioned in rough alignment.

As indicated above in the case of keystone 17, it will be appreciated that not all voussoirs will need to be positioned using the adjustable features of sling 120. For example, in the case of voussoir 12 or 12', sufficient control can be achieved with one of chains 124,126 connected to connector 82 and no connection to connector 45. The same is similarly and necessarily true for the positioning of impost blocks 11, 11' and anchor blocks 112–115 and 112'–115', all of which lack a connector 45. In these cases, a single connection is made to connector 82.

Each mooring shown in FIG. 6 is installed when the associated voussoir has been properly positioned in the partially assembled structure. When the mooring is secure, sling 120 is disconnected, and is then used to place the next voussoir. Turnbuckle 101 is an important element that facilitates this procedure because sling 120 cannot be easily disconnected while carrying any significant portion of the weight of a voussoir. More particularly, before a mooring is established as shown in FIG. 9, a significant portion of the weight of the voussoir may still be carried by sling 120. But by loosely connecting the tension member at first instance, then tensioning the turnbuckle, the weight can be transferred to the mooring. Then, the sling can be relaxed and easily released.

During assembly of each arch segment, the associated moorings serve to hold the segment against inward collapse until keystone 17 is properly positioned. However, it is significant to note that the integrity of a moored arch segment is further assured by the protrusions 50 and mating recesses 60 associated with the respective voussoirs. Such protrusions and recesses impede slippage in any direction across abutting end bearing surfaces of the voussoirs. Further, they serve to transfer some of the weight of upper ones of the voussoirs to lower ones of the voussoirs, thereby relieving part of the load that must be carried by associated tension members.

Despite the foregoing, persons skilled in the art will appreciate that suitable mooring can be achieved by various means other than the means described, for example a tree, a stump or a log buried in the ground. Apart from their bracing function, the role of the anchor blocks shown in FIG. 6 can be completely satisfied by other objects or constructions with sufficient weight, strength or resistance to restrain a moored voussoir from falling inwardly. Depending on the circumstances, individual voussoirs may be secured to separate anchor blocks as indicated in FIG. 6 or may be secured to a common anchor block (not shown).

In any case suitable mooring avoids the need for an underlying support during arch construction. In the present case, mooring is shown for all except lowermost voussoirs 12, 12'. But depending upon the circumstances, it may be found sufficient to moor all or a fewer number of voussoirs. In any given case, the decision will depend upon standard engineering considerations including voussoir weights, frictional forces, moment arm calculations, and so forth.

To finally stabilize arched structure 1, it is necessary to insert keystone 17 between voussoirs 16, 16'. As shown in FIG. 6, keystone 17 is preferably carried in a true horizontal position which facilitates alignment of grooves 26, 27 in keystone 17 for sliding engagement with projections 55 from voussoirs 16 and 16'. If the clearance between voussoirs 16,16' is somewhat tight and resistive to sliding engagement, then it may be widened to a degree by further tensioning the tension members to draw voussoirs 16, 16' away from each other. Once keystone 17 is in place, the tension in the tension members is relaxed to allow voussoirs 16, 16' to bear fully against the opposed sides of the keystone.

When keystone 17 is finally positioned, the moorings may be removed. This is the case for the completed structure shown in FIG. 1. However, in some cases a decision may he made to leave the moorings and tension members in situ to impart added stability in the event of ground movement tending to separate or twist the horizontal span of the arch. In such an event, protrusions 50 and mating recesses 60 of adjacent voussoirs will serve to enhance overall stability (more so than in their absence), but only to a limited degree.

Alternately, a decision may be made to leave the moorings and tension members in situ if arched structure 1 is only a temporary structure intended to be disassembled within a limited period of time. With regard to disassembly, it will be understood that the process can be merely the reverse of the assembly. If in the meantime the moorings and tension members have been removed, then they obviously would have to be reinstalled before disassembly to enable disassembly without the need for underlying support.

Although not shown in the drawings, it will be apparent that a series of individual arched structures like arch structure 1 could be assembled adjacent each other to form an elongated vault-like arched structure. In this construction, the progressive extension of a culvert, tunnel or bridge is a simple matter of building successive single arches against one another. However, to impart added longitudinal stability, a vaulted structure is preferably formed with interlocking staggered rows of voussoirs as shown in FIG. 7.

Figure 7:
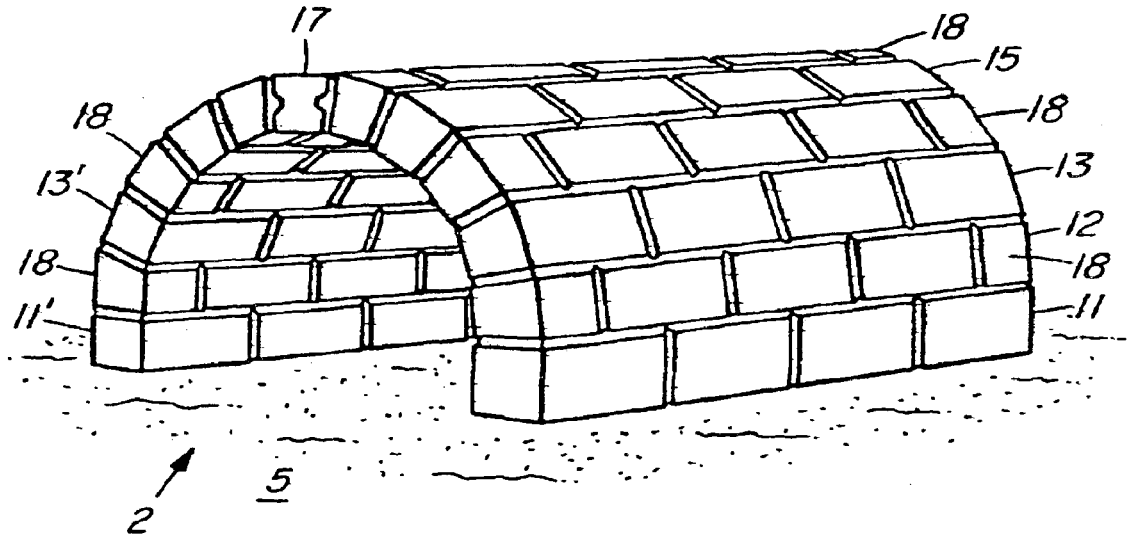
FIG. 7 is a perspective view of a vaulted structure in accordance with the present invention.

In FIG. 7 the vaulted structure generally designated 2 comprises pluralities of impost blocks 11,11', voussoirs 12–16, 12'–16', and keystones 17. In addition, vaulted structure 2 includes a plurality of half length voussoirs 18 used to finish the opposed ends of the structure. The overall length of vaulted structure 2 is four times that of arched structure 1. Its horizontal span is the same as arched structure 1.

Rather than being arranged directly atop one another as in the case of arched structure 1, the voussoirs in vaulted structure 2 are arranged in staggered rows. With the exception of voussoirs 18, each voussoir is supported by an abutting pair of voussoirs or, in the case of voussoirs 12, 12', by an abutting pair of impost blocks 11, 11'. Each voussoir 18 is supported by either a single abutting voussoir or a single impost block.

The assembly of vaulted structure 2 proceeds in substantially the same manner as arched structure 1 utilizing moorings and tension members (not shown in FIG. 7) to stabilize arch segments under construction on either side of the structure at least until keystones 17 are finally positioned. When the structure is completed, and bearing in mind considerations like those outlined above in relation to arched structure 1, the moorings and tension members may or may not be left in situ.

Figure 8:
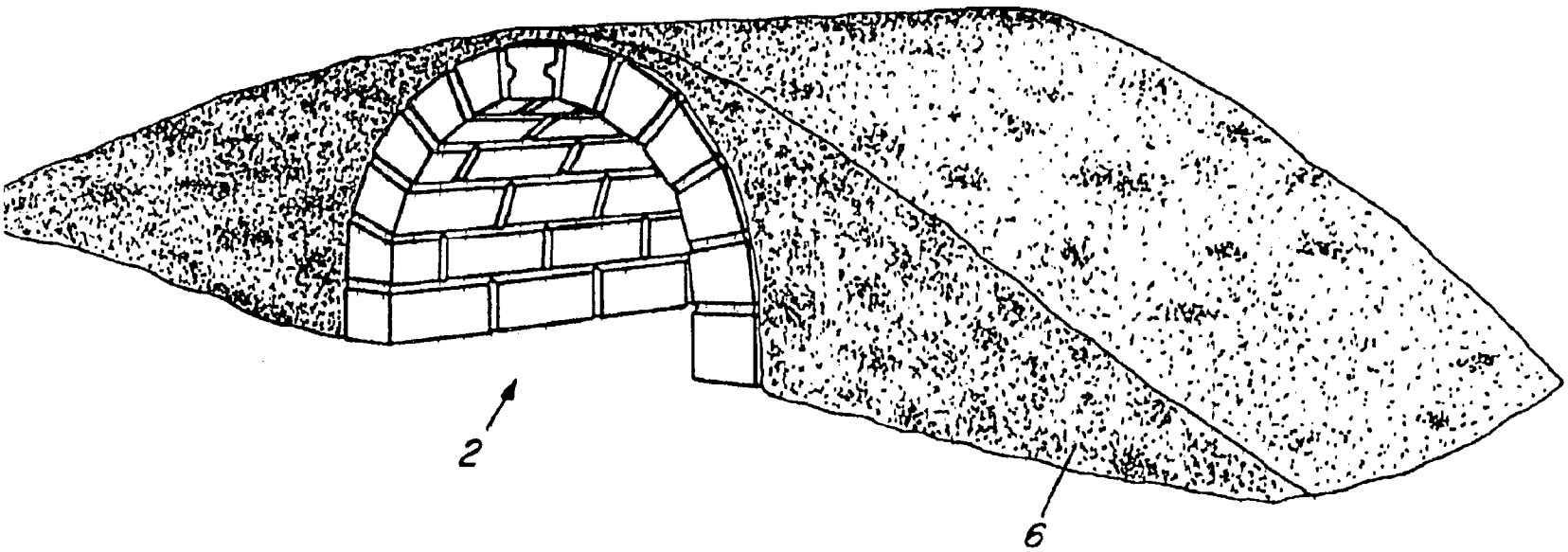
FIG. 8 is a representative view of the structure shown in FIG. 7 with the addition of ground filler over the structure.

In the use of an arched structure constructed in accordance the present invention to provide a bridge or to otherwise permit traffic thereover, an initial fill 6 of earth, rocks, gravel or other aggregate may be piled around the sides of the arch as shown in FIG. 8, and then built up or improved to a greater or lesser degree depending upon the type of traffic to be carried.

A variety of modifications, changes and variations to the invention are possible within the spirit and scope of the following claims, and will undoubtedly occur to those skilled in the art. The invention should not be considered as restricted to the specific embodiments that have been described and illustrated with reference to the drawings.

What is claimed is:

1. A first voussoir for use in an arched structure between second and third voussoirs, said structure having a defined horizontal span, said first voussoir comprising:

a) an intrados surface and an extrados surface, each of said surfaces extending between first and second end hearing surfaces; wherein:

(i) said first end bearing surface includes a protrusion extending from the surface, said protrusion being mateable with a corresponding recess in an abutting end bearing surface of said second voussoir, and (ii) said second end bearing surface includes a recess in said surface, said recess being mateable with a corresponding protrusion in an abutting end bearing surface of said third voussoir;

b) a first connector secured to said first voussoir in or at said extrados surface of said first voussoir for connecting one end of a first flexible tension member to said first voussoir; and, c) a second connector secured to said first voussoir in or at said first end bearing surface of said first voussoir for connecting one end of a second flexible tension member to said first voussoir.

2. A first voussoir as defined in claim 1, wherein:

a) said protrusion extending from said first end bearing surface is mateable with said corresponding recess so as to impair both longitudinal and transverse sliding movement between said first voussoir and said second voussoir; and b) said recess in said second end bearing surface is mateable with said corresponding protrusion so as to impair both longitudinal and transverse sliding movement between said first voussoir and said third voussoir.

3. A first voussoir as defined in claim 1, wherein said protrusion is cross-shaped.

4. A first voussoir for use in, an arched structure between second and third voussoirs, said structure having a defined horizontal span, said first voussoir comprising:

a) an intrados surface and an extrados surface, each of said surfaces extending between first and second and bearing surfaces; wherein:

(i) said first end bearing surface includes a cross-shaped protrusion extending from the surface, said protrusion being matchable with a corresponding recess in an abutting end bearing surface of said second voussoir; and, (ii) said second end bearing surface includes a recess in said surface, said recess being mateable with a corresponding protrusion in an abutting end bearing surface of said third voussoir; and, b) a connector secured to said first voussoir for connecting one end of an associated tension member to said first voussoir while an opposed end of said tension member is connected to an associated mooring positioned at a distance away from said horizontal span.

5. A first voussoir as defined in claim 4, wherein:

a) said protrusion extending from said fist end bearing surface is mateable with said corresponding recess so as to impair both longitudinal and transverse sliding movement between said first voussoir and said second voussoir; and b) said recess in said second end bearing surface is mateable with said corresponding protrusion so as to impair both longitudinal and transverse sliding movement between said first voussoir and said third voussoir.

6. An arched structure comprising a plurality of voussoirs, said structure having a defined horizontal span each of said voussoirs comprising an intrados surface and an extrados surface, each of said surfaces extending between first and second end bearing surfaces, wherein:

a) said first end bearing surface of each voussoir includes a cross-shaped protrusion extending from said first end bearing surface, said protrusion being mated with a corresponding recess in an abutting end bearing surface of a first other one of said voussoirs, wherein said mating between said protrusions and said recesses impairs both longitudinal sliding movement and transverse sliding movement between abutting ones of said voussoirs;

(b) said second end bearing surface of each voussoir includes a recess in said second end bearing surface, said recess being mated with a corresponding protrusion in an abutting end bearing surface of a second other one of said voussoirs; and c) at least some of said voussoirs include an associated connector secured to the voussoir for connecting one end of an associated tension member to the voussoir while an opposed end of the tension member is connected to an associated mooring positioned at a distance away from said horizontal span.

7. An arched structure comprising a plurality of voussoir, said structure having a defined horizontal span, each of said voussoirs comprising an intrados surface and an extrados surface, each of said surfaces extending between first and second end bearing surfaces; wherein a) said first end bearing surface of each voussoir includes a cross-shaped protrusion extending from said first end bearing surface, said protrusion being mated with a corresponding recess in an abutting end bearing surface of a first other one of said voussoirs;

b) said second end bearing surface of each voussoir includes a recess in said second end bearing surface, said recess being mated with a corresponding protrusion in an abutting end bearing surface of a second other one of said voussoirs, said mating between said protrusions and said recesses impairs both longitudinal sliding movement and transverse sliding movement between abutting ones of said voussoirs;

c) at least some of said voussoirs include a connector secured to the voussoir; and d) at least some of said voussoirs having a connector being moored, each by an associated mooring tension member connected at one end to the connector and at an opposed end to an associated mooring positioned at a distance away from said horizontal span.

8. A voussoir for use in construction of an arched structure, said voussoir comprising a body having an intrados surface and an extrados surface, a first end bearing surface and a second end bearing surface, the intrados surface and extrados surface extending between the first and the second end bearing surfaces, the first end bearing surface including a cruciform protrusion extending therefrom and the second end bearing surface including a recess which is complementary in configuration to the protrusion, whereby the protrusion of said voussoir can mateably fit within said recess of an adjacent said voussoir, thereby imparting stability to the arched structure.

9. The voussoir as claimed in claim 8, wherein the body has a connector connected thereto adjacent to the extrados surface, allowing a flexible tension member to be connected to the voussoir.

* * * * *